US008088198B2

(12) United States Patent
Bengtsson et al.

(10) Patent No.: US 8,088,198 B2
(45) Date of Patent: Jan. 3, 2012

(54) WET ELECTROSTATIC PRECIPITATOR

(75) Inventors: Sune Bengtsson, Vaxjo (SE); Rikard Hakansson, Vaxjo (SE)

(73) Assignee: ALSTOM Technology Ltd, Baden (CH)

( * ) Notice: Subject to any disclaimer, the term of this patent is extended or adjusted under 35 U.S.C. 154(b) by 533 days.

(21) Appl. No.: 12/300,370

(22) PCT Filed: May 23, 2007

(86) PCT No.: PCT/EP2007/004568

§ 371 (c)(1),
(2), (4) Date: Nov. 11, 2008

(87) PCT Pub. No.: WO2007/140882

PCT Pub. Date: Dec. 13, 2007

(65) Prior Publication Data

US 2009/0114092 A1 May 7, 2009

(30) Foreign Application Priority Data

Jun. 7, 2006 (SE) ..... 0601248

(51) Int. Cl.
*B03C 3/16* (2006.01)
*B03C 3/78* (2006.01)

(52) U.S. Cl. ..... 95/71; 95/75; 96/44; 96/45; 96/47; 96/50; 96/53; 261/112.1

(58) Field of Classification Search ..... 96/43–50, 96/52, 53; 95/63, 71, 75; 261/111, 112.1
See application file for complete search history.

(56) References Cited

U.S. PATENT DOCUMENTS

| | | | | | |
|---|---|---|---|---|---|
| 1,888,022 | A | * | 11/1932 | Wintermute et al. | 96/45 |
| 2,874,802 | A | * | 2/1959 | Gustafsson et al. | 95/71 |
| 3,444,668 | A | * | 5/1969 | Masuda | 96/47 |
| 3,509,695 | A | * | 5/1970 | Egan et al. | 96/18 |
| 3,958,958 | A | * | 5/1976 | Klugman et al. | 95/64 |

(Continued)

FOREIGN PATENT DOCUMENTS

EP 0415486 3/1991

(Continued)

OTHER PUBLICATIONS

PCT International Search Report (PCT/EP2007/004562) dated Sep. 24, 2007.

(Continued)

*Primary Examiner* — Richard L Chiesa
(74) *Attorney, Agent, or Firm* — Rita D. Vacca

(57) ABSTRACT

A wet electrostatic precipitator (1) includes an inlet (2) for receiving a gas (4) containing a pollutant, and an outlet (6) for discharging therefrom the gas (8) from which said pollutant has been at least partially removed. Nozzles (24) are operative for purposes of spraying liquid onto at least one first vertical collecting surface (30) of at least one collecting electrode (18). A liquid distributor (42) is provided for purposes of pouring liquid onto at least one second vertical collecting surface (44), said at least one second vertical collecting surface (44) being located on a further collecting electrode (36), with said further collecting electrode (36) being located downstream of said at least one collecting electrode (18). The nozzles (24) are located upstream of the liquid distributor (42), as viewed with reference to the direction of flow of the gas. In a method of cleaning the collecting electrodes (18, 36) an upstream electrode (18) is sprayed with liquid while liquid is poured onto a downstream collecting electrode (36).

14 Claims, 6 Drawing Sheets

U.S. PATENT DOCUMENTS

| | | | | | |
|---|---|---|---|---|---|
| 3,958,961 | A | | 5/1976 | Bakke | |
| 4,074,983 | A | * | 2/1978 | Bakke | 96/48 |
| 4,189,308 | A | * | 2/1980 | Feldman | 95/75 |
| 4,553,987 | A | | 11/1985 | Artama et al. | |
| 5,137,546 | A | * | 8/1992 | Steinbacher et al. | 95/71 |
| 5,160,510 | A | * | 11/1992 | Steinbacher et al. | 95/64 |
| 5,624,476 | A | * | 4/1997 | Eyraud | 95/65 |
| 6,302,945 | B1 | * | 10/2001 | Altman et al. | 96/44 |
| 2003/0217642 | A1 | * | 11/2003 | Pasic et al. | 96/44 |

FOREIGN PATENT DOCUMENTS

| | | | | |
|---|---|---|---|---|
| GB | 988350 | | | 7/1965 |
| JP | 4-176346 | A | * | 6/1992 |
| JP | 6-31202 | | | 2/1994 |
| NL | 7702430 | | | 9/1978 |

OTHER PUBLICATIONS

Canadian Office Action dated Aug. 4, 2011.

* cited by examiner

III-III

WET ELECTROSTATIC PRECIPITATOR

CROSS-REFERENCE TO RELATED APPLICATIONS

This application is a national stage filing of PCT/EP2007/004568, filed May 23, 2007, which claims priority to Swedish application 0601248-8, filed Jun. 7, 2006, each of which is incorporated by reference herein in its entirety.

FIELD OF THE INVENTION

The present invention relates to a wet electrostatic precipitator comprising an inlet for receiving a gas containing a pollutant, an outlet for discharging such a gas from which said pollutant has been at least partially removed, a casing through which such a gas flows substantially horizontally from said inlet to said outlet, at least one discharge electrode, and at least one collecting electrode.

The present invention also relates to a method of cleaning at least one collecting electrode of a wet electrostatic precipitator having an inlet for receiving a gas containing a pollutant, and an outlet for discharging such gas from which said pollutant has been at least partially removed.

BACKGROUND OF THE INVENTION

Combustion of coal, oil, industrial waste, domestic waste, peat, etc. produces flue gases that may contain pollutants, such as dust particles, sulphur trioxide ($SO_3$), etc. Pollutants, such as dust particles and sulphur trioxide, can also be produced as a residual product in gases formed in chemical processes, for instance in metallurgical processes. For removing dust particles from a gas it is common to employ an electrostatic precipitator. In the electrostatic precipitator the dust particles are charged by means of discharge electrodes. The charged dust particles are then collected on collecting electrode plates. The dust particles, and any other pollutants that have been collected on the collecting electrode plates, are then removed from the collecting electrode plates and transported away for further processing. For some processes, including processes where very fine dust particles and/or aerosols of, e.g., sulphur trioxide, are to be removed from a gas, a wet electrostatic precipitator is often employed. In a wet electrostatic precipitator a film in the form of a liquid, which is often water, is made to flow, continuously or at certain intervals, along the collecting electrode plates in order to clean the collecting electrode plates by removing the collected dust particles and any other pollutants therefrom. The use of a liquid for cleaning the collecting electrode plates has the advantage that a limited re-entrainment of collected pollutants occurs, as compared to that which occurs in "dry" electrostatic precipitators.

Patent Abstracts of Japan JP 06031202, filed in the name of Chubu Electric Power Co et. al., includes a description of an electrostatic precipitator, which has discharge electrodes and collecting electrodes. As described therein, the collecting electrodes are to be cleaned by means of water supply nozzles. These water supply nozzles spray water towards the collecting electrodes such that the collecting electrodes are cleaned by removing the collected dust particles therefrom. A problem with the electrostatic precipitator, which is described in the aforementioned JP 06031202 document, is that these water supply nozzles create small water droplets and/or aerosols, which in turn are entrained with the gas that is flowing through the electrostatic precipitator. Such water droplets and/or aerosols can cause corrosion problems in the equipment, such as the stacks, fans, reheaters, etc, which are located downstream of the electrostatic precipitator. Also, such water droplets and/or aerosols may in addition cause the emission of dust particles, due to the fact that such entrained water droplets and/or aerosols, in addition to the liquid, may also contain dust particles and dissolved chemicals.

SUMMARY OF THE INVENTION

An object of the present invention is to provide a wet electrostatic precipitator useful for cleaning gases, which wet electrostatic precipitator is provided with means for reducing the amount of liquid droplets and/or aerosols that are entrained with the gas that leaves said wet electrostatic precipitator after such a gas is subjected to cleaning in said wet electrostatic precipitator.

This object is achieved by a wet electrostatic precipitator comprising an inlet for receiving a gas containing a pollutant, an outlet for discharging such a gas from which said pollutant has been at least partially removed, a casing through which such a gas flows substantially horizontally from said inlet to said outlet, at least one discharge electrode, and at least one collecting electrode, characterised in that said wet electrostatic precipitator further comprises a set of nozzles that is operative for spraying liquid onto at least one first vertical collecting surface of said at least one collecting electrode, and at least one liquid distributor that is operative for pouring liquid onto at least one second vertical collecting surface, which is located on said at least one collecting electrode downstream of said at least one first vertical collecting surface, or is located on at least one further collecting electrode, which is located downstream of said at least one collecting electrode, as viewed with reference to the direction of the flow of such a gas, and with the set of nozzles being located upstream of said at least one liquid distributor, as viewed with reference to the direction of the flow of such a gas.

An advantage of this invention is that the set of nozzles, which is operative for spraying liquid onto said at least one first vertical collecting surface, is very efficient in cleaning said at least one first vertical collecting surface, which is located in an upstream region of said wet electrostatic precipitator. A side-effect of such spraying of liquid from such a set of nozzles, which is made in order to clean said at least one first vertical collecting surface, is the formation of liquid droplets. These liquid droplets, which are formed in the upstream region of said wet electrostatic precipitator by the spraying of liquid onto said at least one first vertical collecting surface, are collected on said at least one second vertical collecting surface, which is located in a downstream region of said wet electrostatic precipitator. Thus, said at least one second vertical collecting surface serves as a collector for such liquid droplets. Cleaning of said at least one second vertical collecting surface, which is located in the downstream region of said wet electrostatic precipitator, is accomplished by pouring liquid onto said at least one second vertical collecting surface by means of said at least one liquid distributor. The pouring of such liquid, which is made by means of said at least one liquid distributor, has the advantage that no droplets are formed in the downstream region of said wet electrostatic precipitator, and, thus, the amount of liquid droplets, which leave said wet electrostatic precipitator, is very low. According to what has been described in the prior art, a separate mist eliminator normally needs to be mounted after the wet electrostatic precipitator, in order to effect a reduction in the amount of liquid droplets that is leaving said wet electrostatic precipitator. However, even with the use of such a mist eliminator, the spraying of liquid, for the purpose of cleaning vertical collecting surfaces, must be accomplished with a limited amount of liquid in order to avoid the risk of overloading such a mist eliminator with liquid droplets. In contrast thereto, when the present invention is employed, there is, in most cases, no need for a separate mist eliminator to be utilized after said wet electrostatic precipitator. Furthermore, the cleaning of said at least one second vertical collecting surface in the downstream region of said wet electrostatic precipitator, can, in accordance with the present invention, be accomplished through the use of large amounts of liquid. As a consequence of such large amounts of liquid being used for purposes of cleaning said at least one second vertical collecting surface, the risk of corrosion is reduced, such that, in some cases, the collecting electrodes can be manufactured from cheaper materials, compared to what is possible when the teachings of the prior art are followed.

According to the preferred embodiment of the present invention, said wet electrostatic precipitator further comprises at least a first field and a second field, said first field comprising a first set of discharge electrodes and collecting electrodes, said second field comprising a second set of discharge electrodes and collecting electrodes, a set of nozzles that is operative for spraying liquid onto the first vertical collecting surfaces of the collecting electrodes of said first set of collecting electrodes, a set of liquid distributors being provided for pouring liquid onto the second vertical collecting surfaces of the collecting electrodes of said second set of collecting electrodes, and said second field being located downstream, as viewed with reference the direction of the flow of the gas from which a pollutant is to be at least partially removed, of said first field, and being operative for collecting liquid droplets generated by said set of nozzles. An advantage of this embodiment of the present invention is that the collecting efficiency of such a wet electrostatic precipitator can be more efficiently controlled, due to the fact that said first field thereof can be controlled, with respect to voltage, etc., in order to thereby achieve a high efficiency insofar as the collection of dust particles and/or aerosols is concerned, while the second field can be controlled, with respect to voltage, etc., in order to thereby achieve a high efficiency insofar as the collection of liquid droplets, which are generated by the spraying of liquid from the set of nozzles of said first field, is concerned.

Preferably said second field of such a wet electrostatic precipitator comprises the last field of said wet electrostatic precipitator, and as such is located adjacent to the outlet of said wet electrostatic precipitator. By placing said second field, in which cleaning of the collecting electrodes of such a wet electrostatic precipitator is accomplished by means of the pouring of liquid from the set of liquid distributors, in a last field position insofar as said wet electrostatic precipitator is concerned, said second field thus functions as a so-called "guard-field", thereby ensuring that the amount of dust particles, liquid droplets and/or aerosols leaving said wet electrostatic precipitator will be kept at a sufficiently low level.

According to the preferred embodiment of the present invention, said at least one liquid distributor comprises at least one tube, each said at least one tube extends along a collecting electrode plate and is provided with at least one aperture through which liquid may flow from said at least one tube to a second vertical collecting surface of said collecting electrode plate. An advantage of such an at least one liquid distributor is that such an at least one liquid distributor is efficient in spreading liquid over the entire length of said second vertical collecting surface that is to be cleaned, without liquid droplets being created as a result thereof. Still more preferably, liquid flowing out of said aperture has a velocity of less than 4 m/s. This velocity has proven to be sufficiently low to keep the creation of such liquid droplets at sufficiently low levels.

Preferably at least 50% of the liquid supplied to said at least one liquid distributor is fresh makeup liquid. An advantage that is derived from this embodiment of the present invention is that any liquid from said at least one liquid distributor, which is entrained by the gas, will contain a very low amount of pollutants and, thus, any liquid carried with such gas will result in a very limited contribution to the dust particles that are emitted from such a wet electrostatic precipitator. However, it is still more preferable that substantially all of the liquid, which is supplied to said at least one liquid distributor, be fresh makeup liquid.

Preferably more than 50% of the fresh makeup liquid supplied to such a wet electrostatic precipitator is supplied to said at least one liquid distributor. An advantage to be derived from this is that the liquid and the gas will bear a counter-current flow relation to each other, because the cleanest liquid, which is supplied to said at least one liquid distributor, will be in contact with the purest gas, that is, the gas that has already been cleaned to a great extent in the upstream region of said wet electrostatic precipitator. The result of this is that the emission of dust particles from said wet electrostatic precipitator is decreased, due to the fact that any liquid, which is entrained with the gas, will contain only a small amount of pollutants.

According to one preferred embodiment of the present invention, liquid that has been supplied to said set of nozzles, and liquid that has been supplied to said at least one liquid distributor, are both collected in a common tank. An advantage to be derived from doing so is that liquid supplied to said at least one liquid distributor, which liquid is mostly fresh makeup liquid, effects the dilution of the pollutants, which are captured in the liquid that is supplied to said set of nozzles, such that the liquid collected in said common tank is suitable for feeding to said set of nozzles.

According to another preferred embodiment of the present invention, the wet electrostatic precipitator in accordance therewith includes a casing, which is comprised of at least a first hopper that is operative for receiving liquid from said set of nozzles, and a second hopper, which is separate from said first hopper and which is operative for receiving liquid from said set of liquid distributors. According to this embodiment of the present invention, such liquids can be kept separate from each other, which is an advantage if, for instance, liquid that has been supplied to said set of liquid distributors and, which has been collected in said second hopper, is supposed to be recirculated, usually at least partially, back to said set of liquid distributors. However, it is still preferable that at least some of the liquid, which is collected in said second hopper, be transmitted to said set of nozzles.

According to one preferred embodiment of the present invention, the wet electrostatic precipitator in accordance therewith preferably includes at least one intermediate field that is preferably located between said first field and said second field. The use of such an intermediate field enables the realization of further improved efficiency as regards the efficiency insofar as the collection of dust particles and/or aerosols is concerned. Still more preferably, said at least one intermediate field is provided with nozzles, which are operative for spraying liquid towards the collecting electrodes of said intermediate field. Such spraying is operative for effecting an efficient cleaning of the collecting electrodes of the intermediate field and, due to the fact that said second field functions as a mist eliminator, there is no increased emission of liquid droplets from said wet electrostatic precipitator.

A further object of the present invention is to provide a method of cleaning at least one collecting electrode of a wet electrostatic precipitator, said cleaning being performed in such a manner, that the amount of liquid droplets and/or aerosols, that are entrained with the gas leaving said wet electrostatic precipitator, is reduced.

Such an object is achieved through the use of a method of cleaning at least one collecting electrode of a wet electrostatic precipitator having an inlet for receiving a gas containing a pollutant, and an outlet for discharging such gas from which said pollutant has been at least partially removed, and characterised in that such gas flows substantially horizontally through a casing from said inlet to said outlet of said wet electrostatic precipitator, past at least one discharge electrode and said at least one collecting electrode, liquid is sprayed onto at least one first vertical collecting surface of said at least one collecting electrode, and liquid is poured onto at least one second vertical collecting surface, said at least one second vertical collecting surface either being located on said at least one collecting electrode downstream of said at least one first vertical collecting surface, or being located on at least one further collecting electrode, which is located downstream of said at least one collecting electrode, as viewed with reference to the direction of the flow of the gas through said wet electrostatic precipitator.

An advantage of such a method in accordance with the present invention is that liquid droplets, which are created from the spraying of liquid onto said at least one first vertical collecting surface, are collected on said at least one second vertical collecting surface, said at least one second vertical collecting surface being located downstream of said at least one first vertical collecting surface. Said at least one second vertical collecting surface will thus function as a mist eliminator, such that said at least one second vertical collecting surface is operative to collect liquid droplets that are created during the cleaning of said at least one first vertical collecting surface, which is located upstream, with respect to the direction of flow of the gas through said wet electrostatic precipitator, of said at least one second vertical collecting surface. Due to said at least one second vertical collecting surface being cleaned by means of pouring liquid onto it, there is no, or almost no, creation of liquid droplets during the cleaning of said at least one second vertical collecting surface. Thus, the gas leaving said wet electrostatic precipitator will contain no, or at most very few, such liquid droplets. This method in accordance with the present invention thus provides for an efficient cleaning of said at least one first vertical collecting surface, without resulting in a large amount of liquid droplets being created and thus leaving together with the gas from the wet electrostatic precipitator.

Further objects and features of the present invention will be apparent from the following description and from the claims.

BRIEF DESCRIPTION OF THE DRAWINGS

The invention to which the present application is directed will now be described in more detail with reference to the appended drawings in which.

DESCRIPTION OF PREFERRED EMBODIMENTS

By "spraying liquid", as this term is used in this application, is meant forcing a liquid flow through a nozzle, said nozzle being operative to atomise the liquid flow, such that liquid droplets are formed. In accordance with the present invention, "spraying liquid" is defined as a liquid flow being exposed to atomisation in such a way that at least 90% of such liquid, on a weight basis, produces liquid droplets having a diameter of less than 1.5 mm. Typically, a pressure difference of at least 0.5 bar across the nozzle is required in order to obtain the desired atomisation of the liquid. The liquid droplets that are produced from such atomisation, generally, have an average initial velocity of 8 m/s or more.

By "pouring liquid", as this term is used in this application, is meant causing a liquid to flow through an aperture in such a way that the flow of liquid, following the liquid's passage through said aperture, is in the form of a substantially continuous jet or film. In accordance with the present invention, "pouring liquid" is defined as a flow of liquid being caused to pass through an aperture in such a way that less than 10% of such liquid flow, on a weight basis, produces liquid droplets of a diameter of less than 1.5 mm, and with the main part of the liquid flow thus forming a jet, or a film, upon leaving said aperture. The pressure difference across said aperture preferably should be less than 0.3 bar, in order to thereby avoid the atomisation of the liquid passing through said aperture. The film or jet that is thus formed preferably has an average initial velocity of 4 m/s or less. More preferably, such film or jet has an average initial velocity of less than 2 m/s.

Figure 1:
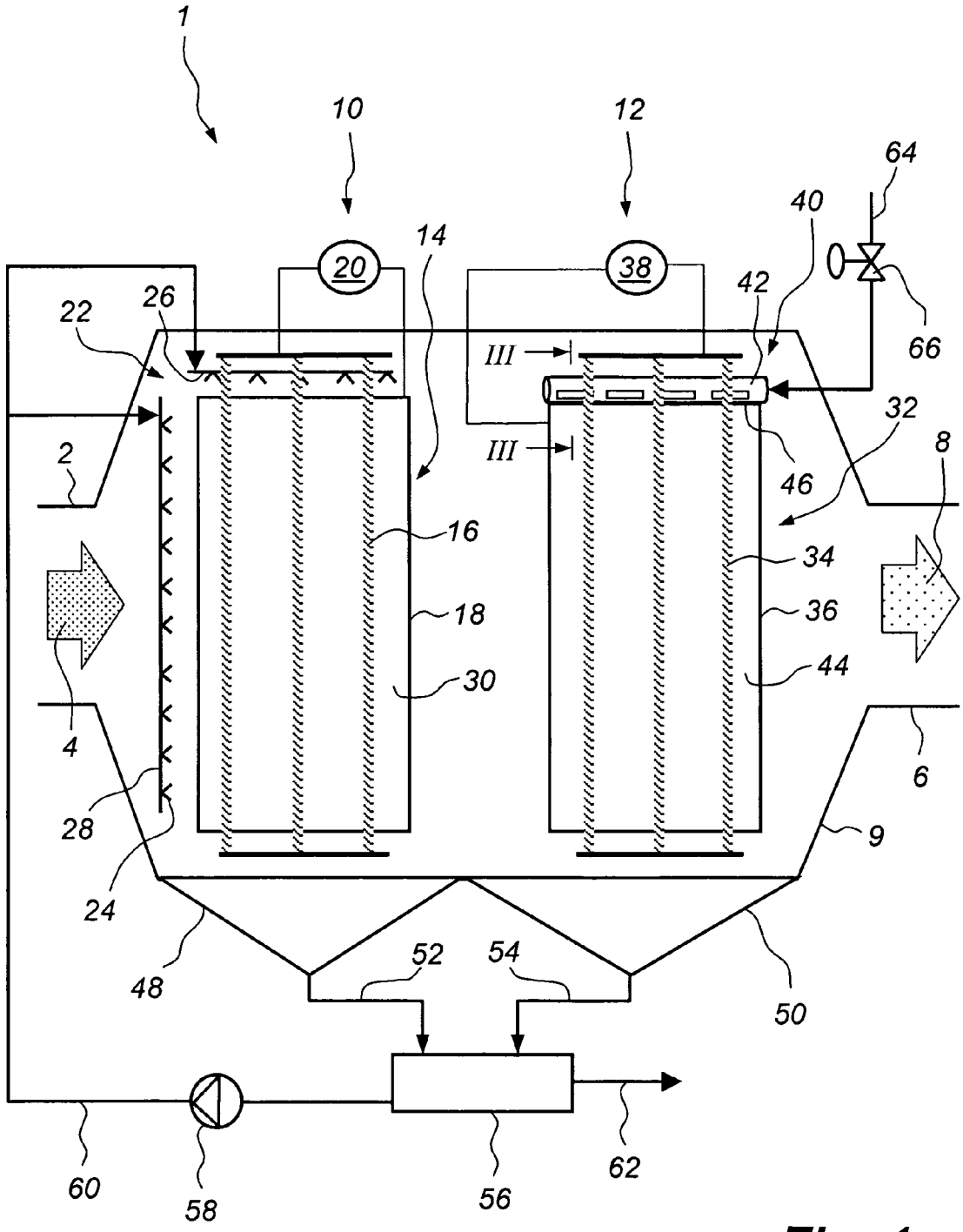
FIG. 1 is a cross-sectional view illustrating a wet electrostatic precipitator, as seen from the side thereof.
Figure 2:
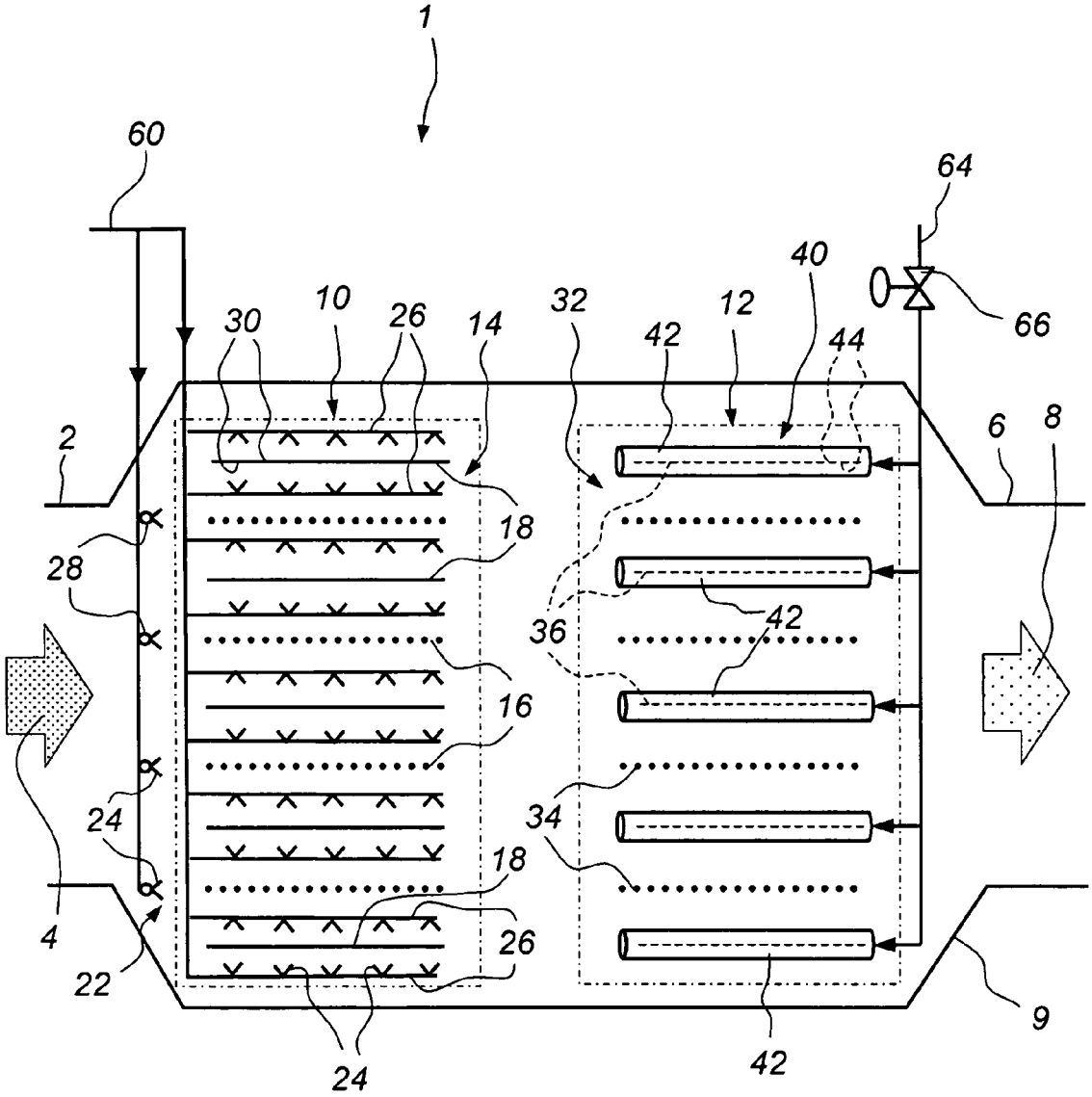
FIG. 2 is a top view illustrating the wet electrostatic precipitator of FIG. 1, as seen from above.

FIG. 1 is a schematic representation of a wet electrostatic precipitator 1, as seen in a cross-sectional view from the side thereof. FIG. 2 depicts the same wet electrostatic precipitator 1 as that shown in FIG. 1 but as seen from above, and with the upper portion of the wet electrostatic precipitator 1 removed for the purpose of providing a clearer illustration. The wet electrostatic precipitator 1 has an inlet 2 for receiving therein flue gas 4, which contains dust particles and/or aerosols, and an outlet 6 for discharging therefrom flue gas 8 from which the dust particles and/or aerosols have been at least partly removed. The flue gas 4 may, for instance, originate from the combustion of coal in a boiler, which is not shown. The wet electrostatic precipitator 1 embodies a casing 9, which is provided with a first field 10, and a second field 12. The second field 12 is located downstream of the first field 10, as viewed with reference to the direction of flow through the wet electrostatic precipitator 1 of the flue gas 4. The first field 10 comprises a first set 14 of discharge electrodes 16 and collecting electrodes, wherein the collecting electrodes are provided in the form of collecting electrode plates 18. The discharge electrodes 16, and the collecting electrode plates 18 are arranged in a similar manner as that previously known in the prior art, see for example in this regard, by way of exemplification and not limitation, Patent Abstracts of Japan JP 06031202. The first field 10 is provided with an independent power source in the form of a rectifier 20, which is connected to the discharge electrodes 16 and the collecting electrode plates 18, and which is operative for purposes of applying a voltage between the discharge electrodes 16 and the collecting electrode plates 18. There is provided a set 22 of nozzles 24 for spraying a liquid, with said liquid often being water, towards the discharge electrodes 16 and the collecting electrode plates 18. This set 22 of nozzles 24 is comprised of a group of upper nozzle lances 26, which are best seen in FIG. 2, and a group of inlet nozzle lances 28. The set 22 of nozzles 24 are provided for the purpose of spraying liquid onto the collecting electrode plates 18 in order to thereby wash away dust particles, aerosols, etc., that have collected on the collecting electrode plates 18. The set 22 of nozzles 24 could be made to be operative either for the purpose of continuously spraying liquid onto the collecting electrode plates 18, or for the purpose of spraying liquid onto the collecting electrode plates 18 in accordance with certain cleaning cycles, such as, for example, for the purpose of spraying liquid onto the collecting electrode plates 18 during 4 occasions per hour, with each such occasion lasting for a period of 1-5 minutes. The type and amount of dust particles and/or aerosol, that are collected on the collecting electrode plates 18 of the wet electrostatic precipitator 1, determine whether continuous spraying or spraying in cycles should be employed. If the pollutant to be collected is corrosive, e.g., if the pollutant is an aerosol of sulphur trioxide, that is, $SO_3$, then it is normally preferable to use continuous spraying in the first field 10 in order to thereby avoid possible corrosion problems.

The group of upper nozzle lances 26, in accordance with the present invention, are preferably arranged so as to spray liquid downwards at an angle of about 0-80° to the vertical plane, and towards the collecting electrode plates 18, as best understood with reference to FIG. 1 and FIG. 2. The nozzles 24 may be of different types depending on which type of wet electrostatic precipitator 1 is being employed. One example of a nozzle, which may be utilized for this purpose, is that known as 9360-3/8LAP-PP25-10, which is a hollow cone nozzle. A further example is GANV 3/8 15, which is a full cone nozzle. Both nozzles are available from Spraying Systems Co., Wheaton, Ill., USA and generate a flow of water of about 10 l/minute at 1.5 bar(o). By "bar(o)", as this term is employed in this application, is meant the pressure above the ambient pressure, i.e., what is generally called "overpressure". At an ambient pressure of 1 bar, an overpressure of 1.5 bar(o) represents an absolute pressure, in bar(a), i.e., a pressure with respect to a vacuum, of 2.5 bar(a). It will be appreciated that the specific choice of nozzle type, which may be employed can differ, and accordingly that many different types of nozzles could be used without departing from the essence of the present invention. Preferably, the nozzles 24, in accordance with the present invention, operate at a liquid pressure of at least 0.5 bar(o) in order to thereby produce an efficient formation of liquid droplets and in order to thereby produce the desired distribution of the liquid droplets over the first vertical collecting surfaces 30 of the collecting electrode plates 18. Employing a very high liquid pressure will result in an increased power consumption. Preferably, the nozzles 24, in accordance with the present invention, operate in a liquid pressure range of 0.5-3 bar(o). The pressure present inside the casing 9 is approximately equal to atmospheric pressure, i.e., normally the pressure inside the casing 9 is in the range 10 kPa below atmospheric pressure to 10 kPa above atmospheric pressure. Thus, the pressure difference to which the liquid is exposed when leaving the nozzles 24 is in the range of 0.5-3 bar. As such, the liquid droplets leaving the nozzles 24 will typically have an average velocity of at least 8 m/s. Preferably, the nozzles 24, in accordance with the present invention, are arranged so as to be operative to provide in addition some cleaning also of the discharge electrodes 16. The nozzles 24 are arranged so as to produce an efficient wetting of the entire first vertical collecting surface 30 of each of the collecting electrode plates 18. Otherwise, any "dry spot" on the first vertical collecting surface 30 of any of the collecting electrode plates 18 may result in the occurrence of corrosion and/or build up of aggregates of collected dust particles. The number of nozzles 24, the type of nozzles 24 and the liquid pressure of the nozzles 24 are all selected so as to enable the foregoing to be realized therefrom. Preferably the type of nozzles 24, and the liquid pressure of the nozzles 24, are each selected so as to thereby produce a droplet size spectrum in which the average droplet size, on a weight basis, is smaller than 1 mm. Preferably, in accordance with the present invention, at least 90% of the droplets, on a weight basis, that are created have a droplet size of less than 1.5 mm The second field 12 comprises a second set 32 of discharge electrodes 34 and collecting electrodes, which preferably consist of the collecting electrode plates 36. The discharge electrodes 34 and the collecting electrode plates 36 both of the second field 12 are arranged in a manner similar to that which has been described hereinbefore insofar as the first field 10 is concerned. The second field 12 includes an independent power source in the form of a rectifier 38, which can be seen in FIG. 1. The rectifier 38 is connected to the discharge electrodes 34 and the collecting electrode plates 36, and is operative for applying a voltage between the discharge electrodes 34 and the collecting electrode plates 36. A set 40 of liquid distributors 42 is provided for the purpose of pouring a liquid, with said liquid often being water, along the second vertical collecting surfaces 44 of the collecting electrode plates 36. The liquid distributors 42 comprise a plurality of tubes 42, each of which extends along an upper edge 46 of a respective one of the collecting electrode plate 36. In FIG. 2, the collecting electrode plates 36 are hidden from view by virtue of the presence therein of the liquid distributors 42. The set 40 of liquid distributors 42 is provided for the purpose of enabling the dust particles, aerosols, etc. to be washed away, which have collected on the second vertical collecting surfaces 44 of the collecting electrode plates 36.

When the wet electrostatic precipitator 1 is in operation, the rectifier 20 applies a voltage between the discharge electrodes 16 and the collecting electrode plates 18 of the first set 14 thereof, and the rectifier 38 applies a voltage between the discharge electrodes 34 and the collecting electrode plates 36 of the second set 32 thereof. As best understood with reference to FIG. 1 and FIG. 2, the flue gas 4 enters the casing 9 via the inlet 2. As such, the flue gas 4 first reaches the field 10. Thus, the dust particles and/or aerosols, which are entrained in the flue gas 4, become charged by the discharge electrodes 16, and these dust particles and/or aerosols are then subsequently attracted to the collecting electrode plates 18, on the surface of which the dust particles and/or aerosols are collected. The liquid, which is sprayed by the set 22 of nozzles 24, produces a liquid film that flows along the first vertical collecting surfaces 30 of the collecting electrode plates 18, and as such is operative to cleanse the collected dust particles and/or aerosols therefrom. Such dust particles and/or aerosols, as well as such liquid, are collected in a first hopper 48, which as shown in FIG. 1 is located below the first set 14 of discharge electrodes 16 and collecting electrode plates 18.

The liquid droplets, which are created as a result of the spraying from the nozzles 24, will, to some extent, follow the flue gas 4 as the flue gas 4 flows from the first field 10 to the second field 12. In the second field 12, the discharge electrodes 34 of the second set 32 will charge these liquid droplets that flow thereto from the first field 10. These liquid droplets are subsequently collected on the collecting electrode plates 36 of the second set 32. The relatively small amounts of dust particles and/or aerosols, that are not collected in the first field 10, and which are made to flow to the second field 12, will also be charged by the discharge electrodes 34 and will be collected on the collecting electrode plates 36. The liquid that is poured, by means of the liquid distributors 42, along the second vertical collecting surfaces 44 of the collecting electrode plates 36, is operative to effect the cleaning of the collecting electrode plates 36. The liquid droplets, which are collected, as well as the pouring liquid and the dust particles and/or aerosols are all collected in a second hopper 50.

The first field 10 in accordance with the present invention functions as the main collector of dust particles and/or aerosols. Typically more than about 70% of the total amount of dust particles and/or aerosols that are collected in the wet electrostatic precipitator 1 are collected in the first field 10. Due to the fact that the concentration of dust particles in the first field 10 is high as compared to that present in the second field 12, it is of necessity a requirement that the collecting electrode plates 18 of the first field 10 be cleaned very efficiently. This is achievable through the use of the set 22 of nozzles 24. In addition, preferably, the nozzles 24 are designed to be operable to provide some cleaning of the discharge electrodes 16. The second field 12 in accordance with the present invention functions as a mist eliminator, by which is meant the fact that the second field 12 collects the liquid droplets that are entrained in the flue gas 4 that flows from the first field 10 to the second field 12. As a consequence of the liquid distributors 42 pouring the liquid on the collecting electrode plates 36, there are almost no liquid droplets created in the second field 12. Thus, almost no liquid droplets are entrained in the flue gas 8 that is discharged from the wet electrostatic precipitator 1. In addition to functioning as a mist eliminator, the second field 12 in accordance with the present invention also functions to remove much of the dust particles and/or aerosols that still remain entrained in the flue gas 4 after the flue gas 4 passes through the first field 10. Accordingly, the second field 12 performs the dual functions both of that of removing liquid droplets, and that of cleaning dust particles and/or aerosols from the flue gas 4. Due to the fact that the concentration of dust particles is lower in the second field 12, as compared to that present in the first field 10, the need, insofar as the efficient cleaning of the second vertical collecting surfaces 44 is concerned, is generally lower than for the first vertical collecting surfaces 30. Further, there is often no need to clean the discharge electrodes 34 of the second set 32. As such, it is normally sufficient to effect the cleaning of the second vertical collecting surfaces 44 simply by means of pouring liquid onto them. If a need for additional cleaning of the discharge electrodes 34 of the second field 12 should arise, this need can be addressed by providing the discharge electrodes 34 with liquid distributors, which embody a design similar to that of the liquid distributors 42 that have been described hereinbefore as being employed for purposes of effecting therewith the cleaning of the collecting electrode plates 36.

As will be best understood with reference to FIG. 1, the liquid, dust particles and/or aerosols, which are collected in the hoppers 48 and 50, are transferred, via pipes 52 and 54, respectively, to a tank 56. A pump 58 is employed to pump liquid from the tank 56, via a pipe 60, to the set 22 of nozzles 24. In order to avoid in such liquid a too high concentration of pollutants, in the form of collected dust particles and/or aerosols, in the liquid, a portion of such liquid is removed from the tank 56 via a pipe 62. The liquid, which is so removed, is brought to a liquid treatment plant, which is not shown in the drawings, or may be utilized, if so desired, without departing from the essence of the present invention in an upstream gas cleaning device, such as, for example, a wet scrubber. In accordance with the present invention, fresh makeup liquid preferably is fed to the set 40 of liquid distributors 42 via a pipe 64. A valve 66 is used to control the flow of such makeup liquid to the liquid distributors 42. As shown in FIG. 1, in accordance with the present invention all of the fresh makeup liquid preferably is provided to the liquid distributors 42, while the set 22 of nozzles 24 is provided with liquid that is recirculated from the tank 56. The advantage of doing this is that, if any droplets are formed, by accident, in the second field 12, such droplets would consist of substantially pure liquid, e.g., water, and as such would not contribute to the emission of dust particles from the wet electrostatic precipitator 1. The recirculated, that is, "dirty", liquid, which is provided to the nozzles 24, operates to create liquid droplets that contain a certain amount of pollutants, but as has been described hereinbefore previously such liquid droplets are collected in the second field 12.

Figure 3:
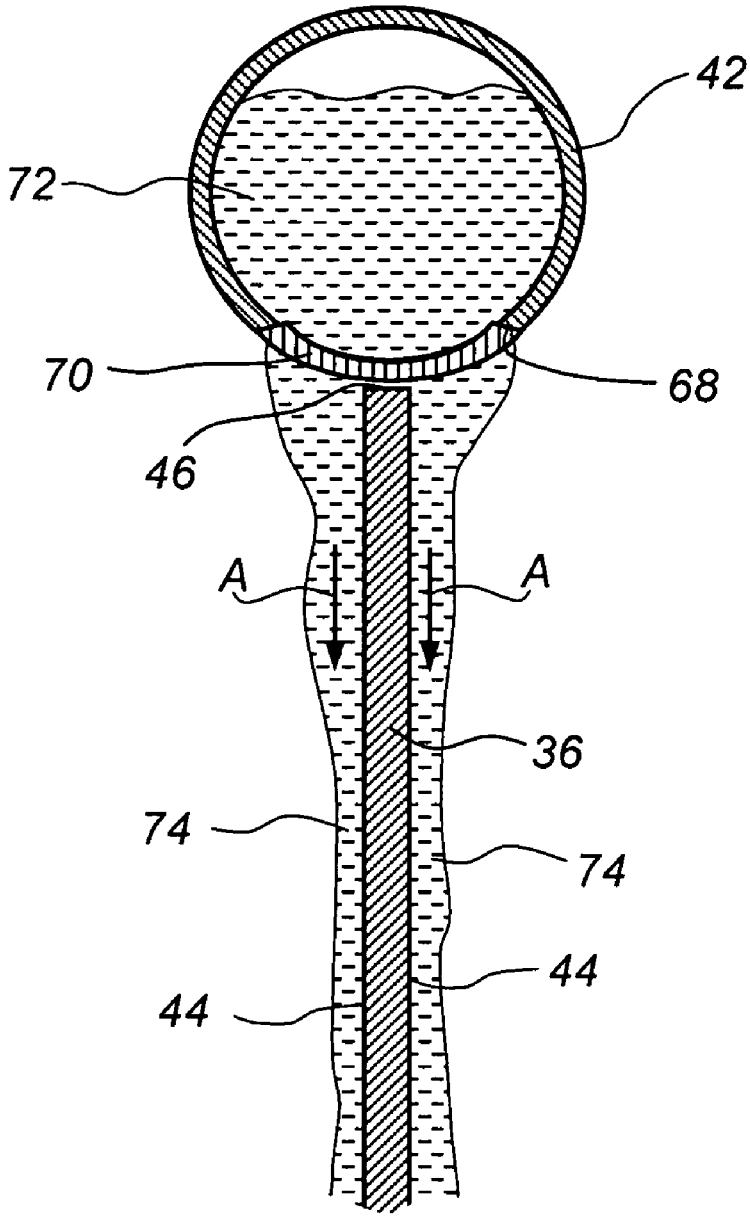
FIG. 3 is an enlarged cross-sectional view illustrating a liquid distributor taken along the line III-III in FIG. 1.

In FIG. 3, the liquid distributor 42, which is located above the collecting electrode plate 36 and which extends along the upper edge 46 of the collecting electrode plate 36, is illustrated in more detail. As best understood with reference to FIG. 3, the liquid distributor 42 embodies the shape of a tube 42 and is provided with an aperture 68, which is in the form of a slit and is located in the lower portion of the tube 42. The aperture 68 is covered by a distributor means 70. The distributor means 70 is made from a porous sintered metal. Liquid, generally in the form of fresh makeup water 72, is fed to the liquid distributor 42 by means of the pipe 64, which is shown in both FIGS. 1 and 2. The liquid 72 penetrates the distributor means 70 and is operative to form liquid films 74 on both sides of the collecting electrode plate 36. As illustrated in FIG. 3, the liquid films 74 flow, as indicated by arrows A, downwards along the second vertical collecting surfaces 44 of the collecting electrode plate 36, and in doing so are operative to clean any dust particles and/or aerosols that may have collected on the second vertical collecting surfaces 44. Due to the fact that the liquid films 74 comprise continuous films, much of the dust particles and/or aerosols that are collected, will be captured directly by the liquid films 74. The liquid 72 is only pressurized to the extent necessary to penetrate the distributor means 70 and to the extent necessary to generate an even flow distribution, i.e., each film 74 should have a substantially even thickness over the horizontal length of the respective second vertical collecting surface 44. In some cases the gravity of the liquid 72 inside the liquid distributor 42 may be sufficient for causing the liquid 72 to penetrate the distributor means 70. In other cases, a slight pressure may have to be applied in order to cause the liquid 72 to penetrate the distributor means 70. In any event, the liquid 72 is poured onto the second vertical collecting surfaces 44, and is not sprayed thereon. Thus, there is no, or almost no, creation of liquid droplets as a result thereof.

To avoid the creation of liquid droplets in the second field 12, in accordance with the present invention the pressure difference, between the inside of the liquid distributor 42 and the flue gas 4 inside the wet electrostatic precipitator 1, is preferably less than about 0.3 bar. Due to the fact that the absolute pressure present inside the wet electrostatic precipitator 1 is approximately equal to atmospheric pressure, in accordance with the present invention the liquid pressure inside the liquid distributor 42 is preferably less than 0.3 bar(o). Thus, the pressure difference, to which the liquid 72 is exposed when leaving the liquid distributor 42, is preferably in the range of 0-0.3 bar, and the velocity of the liquid 72, when leaving the liquid distributor 42, is preferably less than 4 m/s, and in order to avoid the creation of liquid droplets, more specifically, preferably less than 2 m/s. Typically, the velocity of the liquid 72, when leaving the liquid distributor 42, is in the range of 0.1 to 0.5 m/s.

Figure 4:
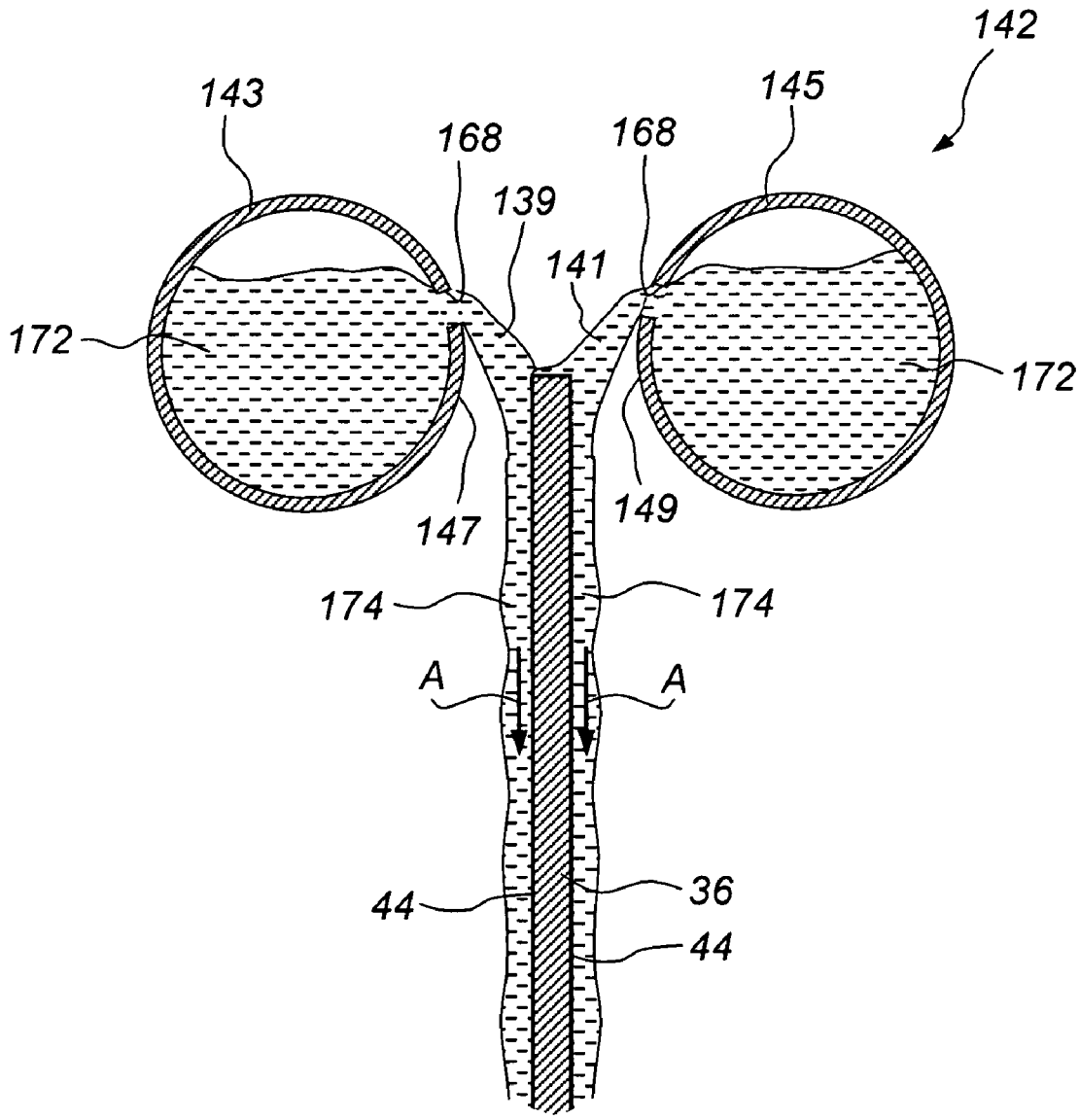
FIG. 4 is an enlarged cross-sectional view illustrating a liquid distributor that embodies an alternative design.

FIG. 4 is a cross-sectional view and depicted therein is a liquid distributor 142 constructed in accordance with an alternative embodiment of the present invention. As illustrated in FIG. 4, the liquid distributor 142 embodies a first tube 143 and a second tube 145, with the tubes 143, 145 being located on opposite sides of the collecting electrode plate 36. Each of the tube 143, 145 is provided with a plurality of apertures 168, which are in the form of circular holes, with the apertures 168 being distributed along the length of the respective one of the tubes 143, 145. The apertures 168 are provided in a side portion 147 of the tube 143 and in a side portion 149 of the tube 145, respectively. These respective side portions 147, 149 are located adjacent to the collecting electrode plate 36. Liquid, preferably in the form of fresh makeup water 172, is supplied from a source, which is not shown in the drawings, to each of the tubes 143, 145, and as a consequence of overflow is caused to leave, in the form of the jets 139, 141, each of the tubes 143, 145 via the apertures 168. In accordance with the present invention, the flow of the jets 139, 141 is at a low liquid velocity, namely, preferably at a velocity, which is less than about 1 m/s. The liquid 172 is thus poured onto the second vertical collecting surfaces 44 of the collecting electrode plate 36 and is operative to form the liquid films 174, which flow vertically downwards along the second vertical collecting surfaces 44, as is depicted in FIG. 4 by the arrows A. Due to the fact, that basically no pressure is involved when the liquid 172 overflows from each of the tubes 143, 145 to the collecting electrode plate 36 via the apertures 168, there is no, or almost no, creation of liquid droplets as a result.

Figure 5:
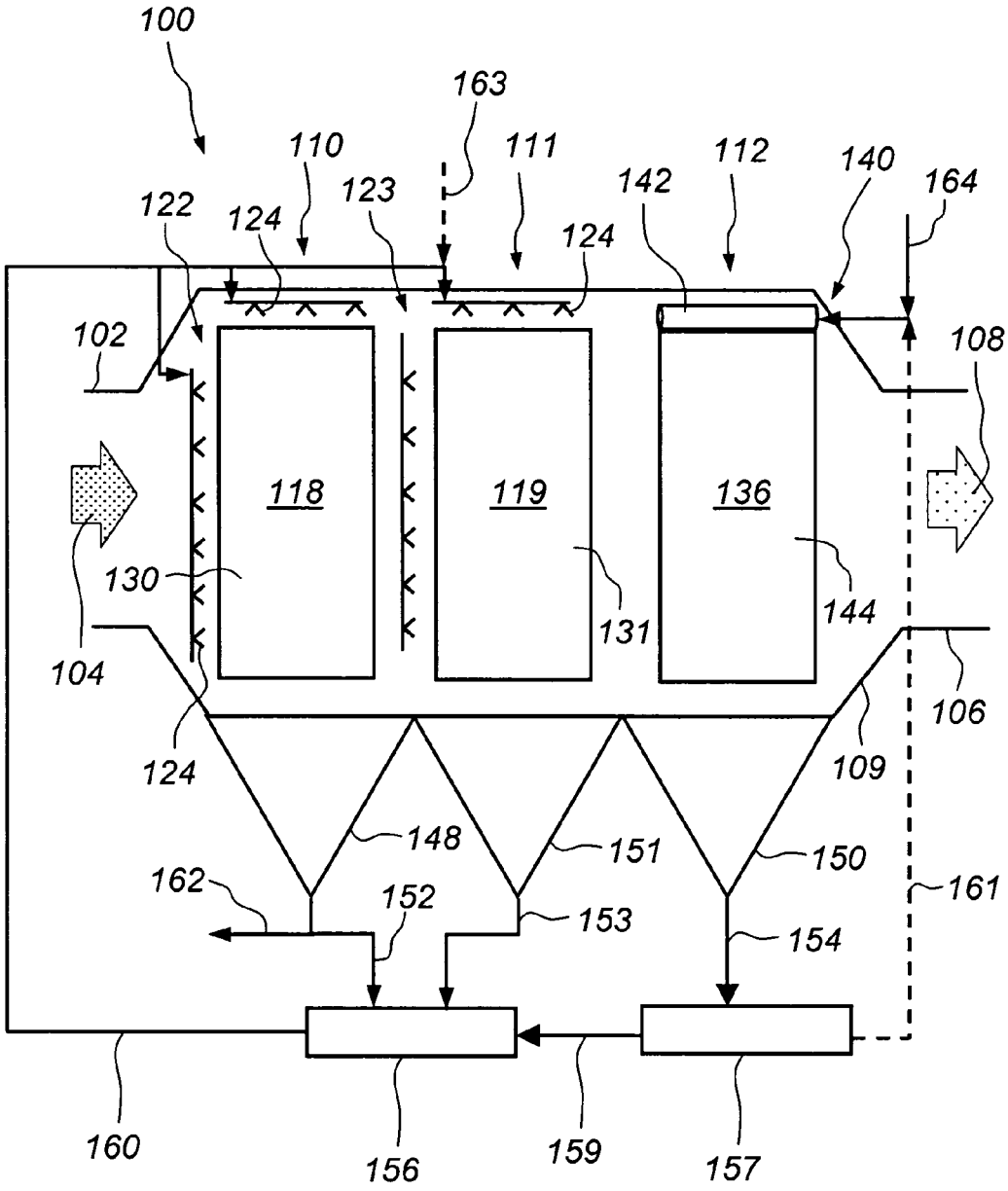
FIG. 5 is a cross-sectional view illustrating a wet electrostatic precipitator, according to a second embodiment of the present invention, as seen from the side thereof.

FIG. 5 is a schematic depiction of a wet electrostatic precipitator 100, which is constructed in accordance with a second embodiment of the present invention. The wet electrostatic precipitator 100 includes an inlet 102 for receiving the flue gas 104, that has dust particles and/or aerosols entrained therein, an outlet 106 for discharging the flue gas 108 therefrom, from which most of the dust particles and/or aerosols, which were entrained in the flue gas 104, have been removed, and a casing 109. The wet electrostatic precipitator 100 further includes a first field 110, which is located adjacent to the inlet 102, and a second field 112, which is located adjacent to the outlet 106. In accordance with this second embodiment of the present invention, an intermediate field 111 is preferably located between the first field 110 and the second field 112, wherein the second field 112 comprises the last field in the wet electrostatic precipitator 100 to which reference has been made herein previously. Each of the fields 110, 111, 112 is provided with a set of discharge electrodes and collecting electrode plates, and a rectifier. The sets of discharge electrodes and collecting electrode plates, and the rectifiers, are of a design similar to that of the corresponding components that are shown in FIG. 1, and in the interest of maintaining clarity of illustration in the drawings are, therefore, not shown in detail in FIG. 5. The first field 110 includes collecting electrode plates, of which one collecting electrode plate 118 is shown in FIG. 5, and each of which has first vertical collecting surfaces, of which a first vertical collecting surface 130 is shown in FIG. 5. In a similar manner, the intermediate field 111 includes collecting electrode plates 119, each of which having intermediate vertical collecting surfaces 131, and the second field 112 has collecting electrode plates 136, each of which having second vertical collecting surfaces 144. The collecting electrode plates 118 of the first field 110 and the collecting electrode plates 119 of the intermediate field 111 are designed to be cleaned by means of a first set 122 of nozzles 124 and a second set 123 of nozzles 124, respectively. The cleaning of the collecting electrode plates 136 of the second field 112 is effected by means of a set 140 of liquid distributors 142, each of which is of the same design as that which has been described hereinabove in connection with the discussion of the subject matter that is illustrated in FIG. 4. With further reference to FIG. 5, the liquid flowing down from the first field 110 is collected in a first hopper 148. A first portion of the liquid collected in the first hopper 148 is transported, via a pipe 152, to a first tank 156. A second portion of the liquid, which is collected in the first hopper 148, is removed from circulation via a pipe 162 and is brought to, e.g., a liquid treatment plant, which is not shown in the drawings. The liquid flowing down from the intermediate field 111 is collected in an intermediate hopper 151, and is transported, via a pipe 153, to the first tank 156. A pump, not shown in the drawings, is operative to pump liquid via a pipe 160 both to the first set 122 of nozzles 124 and to the second set 123 of nozzles 124. The liquid distributors 142 are supplied with liquid in the form of fresh makeup liquid, which preferably, in accordance with the present invention, is in the form of water, via a pipe 164. The liquid flowing down from the second field 112 is collected in a second hopper 150. The second hopper 150, which is separate from both the first hopper 148 and the intermediate hopper 151, drains via a pipe 154 into a second tank 157. A pipe 159 transports liquid from the second tank 157 to the first tank 156. As an option, without departing from the essence of the present invention, some liquid from the second tank 157 could be recirculated back to the liquid distributors 142 via a pipe 161. Preferably, at least 50% of the liquid, which is supplied to the liquid distributors 142 of the second field 112, is fresh makeup water, with the rest of the liquid, to the extent that there is any, being recirculated from the second tank 157. Yet another option, without departing from the essence of the present invention, is to transport some of the fresh makeup water to the second set 123 of nozzles 124 of the intermediate field 111 via a pipe 163. Preferably, in accordance with the present invention at least 50% of the total amount of fresh makeup water, which is supplied to the wet electrostatic precipitator 100, is supplied to the second, i.e., the last, field 112 via the pipe 164. The provision of an extra field, in the form of the intermediate field 111, increases the removal efficiency insofar as dust particles and/or aerosols are concerned. Due to the fact that the second field 112, which is the last field of the wet electrostatic precipitator 100, functions as a mist eliminator, the employment of the nozzles 124 for spraying the collecting electrode plates 119 of the intermediate field 111 will not lead to any increase in the amount of liquid droplets that leave the wet electrostatic precipitator 100 entrained in the flue gas 108. In the wet electrostatic precipitator 100 the fresh makeup liquid is mainly, if not entirely, transported to the second field 112, which comprises the last field thereof, so that any liquid droplets, which are created, unintentionally, are comprised principally of pure liquid, e.g., pure water, and with only low concentrations of dust particles and/or aerosols being contained therewith. Liquid from the wet electrostatic precipitator 100 is disposed of from the first hopper 148, and it is in the first hopper 148 that the most contaminated liquid can be expected to be found.

Figure 6:
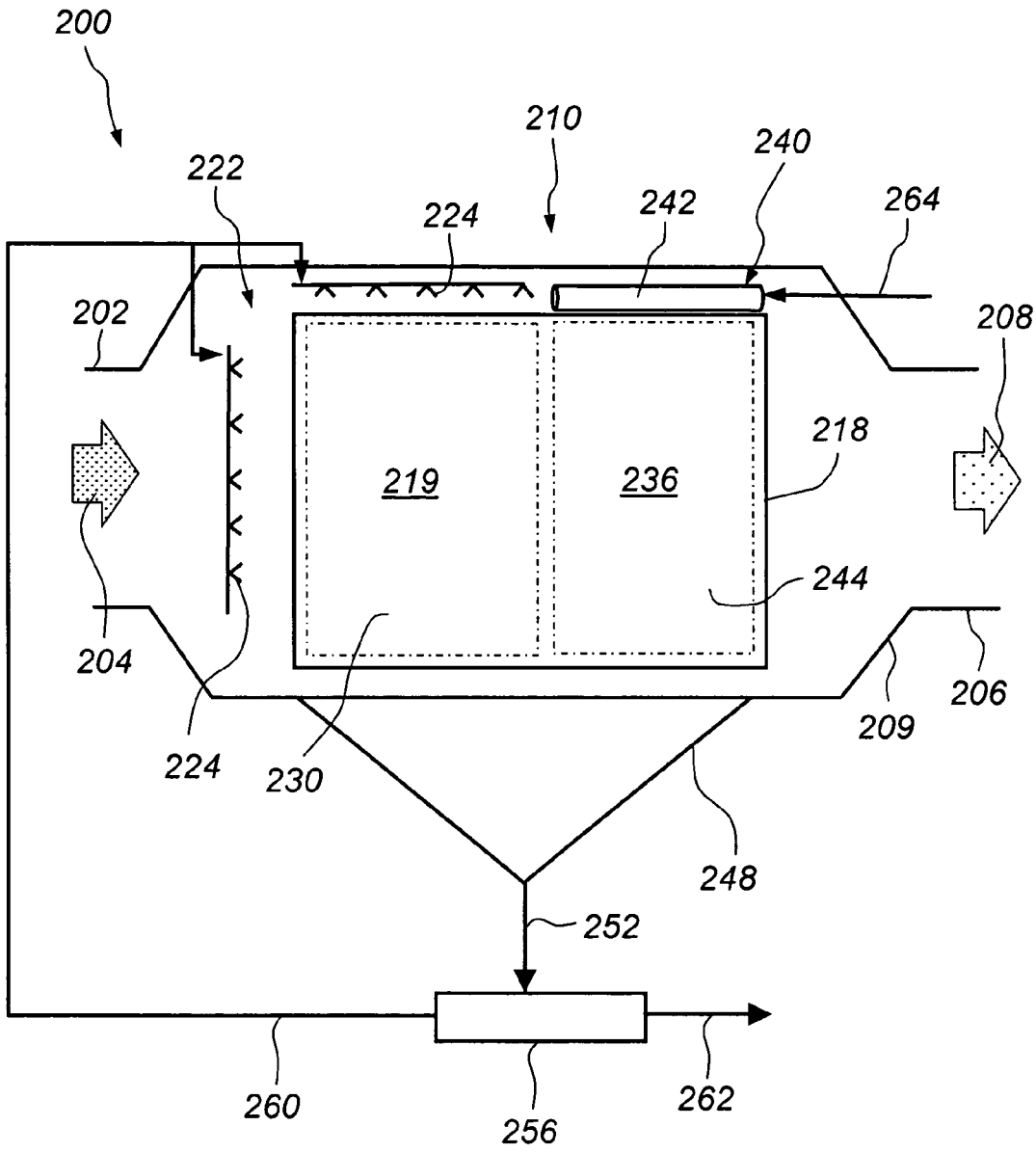
FIG. 6 is a cross-sectional view illustrating a wet electrostatic precipitator, according to a third embodiment of the present invention, as seen from the side thereof.

FIG. 6 is a schematic illustration of a wet electrostatic precipitator 200 according to a third embodiment of the present invention. The wet electrostatic precipitator 200, as illustrated in FIG. 6, includes an inlet 202 for receiving the flue gas 204, which has dust particles and/or aerosols entrained therein, an outlet 206 for discharging the flue gas 208 therefrom, from which the dust particles and/or aerosols, which were entrained in the flue gas 204, have been at least partly removed, and a casing 209. The wet electrostatic precipitator 200 further includes a single field 210. The field 210 includes a set of discharge electrodes, which are not shown in FIG. 6, and collecting electrode plates, of which one collecting electrode plate 218 is depicted in FIG. 6. A rectifier, which is not shown in FIG. 6, is operative for purposes of applying a voltage between the discharge electrodes and the collecting electrode plates 218, in a manner similar to that which has been described hereinbefore in connection with the discussion of the subject matter that is illustrated in FIG. 1. The collecting electrode plate 218 is divided into a first portion 219, which is located adjacent to the inlet 202, and a second portion 236, which is located adjacent to the outlet 206. Thus, the second portion 236 is located down-stream of the first portion 219. The area of the first portion 219, and the area of the second portion 236 are each depicted in FIG. 6 by means of a dotted line. The first portion 219 of the collecting electrode plate 218 includes a first vertical collecting surface 230, which is designed to be cleaned by means of a set 222 of nozzles 224. Accordingly, the nozzles 224 are operative for purposes of spraying liquid onto the first vertical collecting surface 230. The second portion 236 of the collecting electrode plate 218 includes a second vertical collecting surface 244, which is designed to be cleaned by means of a set 240 of liquid distributors, of which only one liquid distributor 242, in the interest of maintaining clarity of illustration therein, is shown in FIG. 6. Preferably, in accordance with this third embodiment of the present invention the liquid distributor 242 is of a design similar to that of the liquid distributors 42, 142, which have been described hereinbefore in connection with the discussion of the subject matter that is illustrated in FIG. 3 and FIG. 4. The liquid distributor 242 is operative for purposes of pouring a liquid, such as, for example, water, onto the second vertical collecting surface 244. Fresh makeup liquid, which in accordance with the present invention is preferably water, is supplied to the liquid distributor 242 via a pipe 264. Liquid, which is collected in a hopper 248, is transported to a tank 256 via a pipe 252. Liquid from the tank 256 is transported via a pipe 260 and a pump, the pump not being shown in the drawings, to the set 222 of nozzles 224. Liquid is discharged from the wet electrostatic precipitator 200 via a pipe 262. In the wet electrostatic precipitator 200, which is depicted in FIG. 6, the first portion 219 of the collecting electrode plate 218 functions as the main collector of dust particles and/or aerosols. The second portion 236 of the collecting electrode plate 218 functions as a mist eliminator, which collects liquid droplets that have been created as a consequence of the spraying from the nozzles 224, which nozzles 224 are operative for purposes of effecting therewith the cleaning of the first vertical collecting surface 230 of the first portion 219. In addition to collecting liquid droplets, the second portion 236 of the collecting electrode plate 218 functions to also collect some of the dust particles and/or aerosols that have not been collected in the first portion 219 of the collecting electrode plate 218. Thus, the wet electrostatic precipitator 200, which is depicted in FIG. 6, enables it to be possible to combine the efficient removal of dust particles and/or aerosols, with the efficient removal of liquid droplets through the employment of only one single field 210.

It will be appreciated that numerous variants of the above described embodiments are possible within the scope of the appended claims.

To thus summarize, it has been described hereinbefore, that a wet electrostatic precipitator 1, 100, 200 according to the present invention could have one field 210, as depicted in FIG. 6, two fields 10, 12, as is depicted in FIG. 1 and FIG. 2, or three fields 110, 111, 112, as is depicted in FIG. 5. It will be appreciated, that further fields could also be provided, without departing from the essence of the present invention, so that the wet electrostatic precipitator would have four, five or even more fields. In this regard, most frequently, two to five fields are employed. In accordance with the present invention, it is preferable, but not necessary, that the last field 12, 112, respectively, of the wet electrostatic precipitator 1, 100 be provided with a set 40, 140 of liquid distributors 42, 142, and, that the other fields 10, 110, 111, e.g., fields one to four, in a wet electrostatic precipitator having five fields, be provided with sets 22, 122, 123 of nozzles 24, 124. It is also possible, however, that fields three and five, of a wet electrostatic precipitator having five fields, be provided with sets of liquid distributors, while fields one, two and four be provided with sets of nozzles. In the latter case, the amount of liquid droplets that must be collected by the fifth field, which is the last field of the wet electrostatic precipitator, is decreased, which as such decreases the burden on the fifth field.

FIG. 3 and FIG. 4 depict two different designs of liquid distributors 42, 142. It will be appreciated that other designs of liquid distributors are also possible without departing from the essence of the present invention. Examples of such other designs include, by way of exemplification and not limitation, square or rectangular tubes, open elongated channels with overflow means, etc.

The invention claimed is:

1. A wet electrostatic precipitator comprising:

an inlet for receiving a gas containing a pollutant, an outlet for discharging therefrom the gas from which said pollutant has been at least partially removed, a casing through which the gas flows substantially horizontally from said inlet to said outlet, at least one discharge electrode, at least one collecting electrode, a set of nozzles for spraying liquid onto at least one first vertical collecting surface of said at least one collecting electrode, and at least one liquid distributor for pouring liquid onto at least one second vertical collecting surface, said at least one second vertical collecting surface located at least on one of said at least one collecting electrode downstream of said at least one first vertical collecting surface and of at least one further collecting electrode, said at least one further collecting electrode located downstream of said at least one collecting electrode, said set of nozzles located upstream of said at least one liquid distributor.

2. A wet electrostatic precipitator according to claim 1, wherein the wet electrostatic precipitator further comprises at least a first field and a second field, said first field comprising a first set of discharge electrodes and collecting electrodes, said second field comprising a second set of discharge electrodes and collecting electrodes, said set of nozzles for spraying liquid onto the first vertical collecting surfaces of the collecting electrodes of said first set, a set of liquid distributors for pouring liquid onto the second vertical collecting surfaces of the collecting electrodes of said second set, and said second field located downstream of said first field, for collection of liquid droplets from said set of nozzles.

3. A wet electrostatic precipitator according to claim 2, wherein said second field is the last field located adjacent to said outlet.

4. A wet electrostatic precipitator according to claim 1, wherein said at least one liquid distributor comprises at least one tube, each of said at least one tube extending along the collecting electrode plate and embodying at least one aperture through which the liquid may flow from the tube to the second vertical collecting surface of the collecting electrode plate.

5. A wet electrostatic precipitator according to claim 4, wherein the liquid flowing out of said aperture has a velocity of less than 4 m/s.

6. A wet electrostatic precipitator according to claim 1, wherein at least 50% of the liquid supplied to said at least one liquid distributor is fresh makeup liquid.

7. A wet electrostatic precipitator according to claim 6, wherein substantially all of the liquid supplied to said at least one liquid distributor is fresh makeup liquid.

8. A wet electrostatic precipitator according to claim 1, wherein more than 50% of the fresh makeup liquid supplied to the wet electrostatic precipitator is supplied to said at least one liquid distributor.

9. A wet electrostatic precipitator according to claim 1, wherein the liquid that has been supplied to said set of nozzles, and the liquid that has been supplied to said at least one liquid distributor, are collected in a common tank.

10. A wet electrostatic precipitator according to claim 2, wherein said casing comprises at least a first hopper for receiving liquid from said set of nozzles, and a second hopper, separate from said first hopper for receiving liquid from said set of liquid distributors.

11. A wet electrostatic precipitator according to claim 10, wherein at least some of the liquid collected in said second hopper is transported to said set of nozzles.

12. A wet electrostatic precipitator according to claim 2, wherein at least one intermediate field is located between said first field and said second field.

13. A wet electrostatic precipitator according to claim 12, wherein said at least one intermediate field is provided with nozzles for spraying liquid towards the collecting electrodes of said intermediate field.

14. A method of cleaning at least one collecting electrode of a wet electrostatic precipitator having an inlet for receiving a gas containing a pollutant, and an outlet for discharging therefrom the gas from which said pollutant has been at least partially removed, the method comprising:

transporting the gas substantially horizontally from said inlet to said outlet, past at least one discharge electrode and said at least one collecting electrode, spraying liquid onto at least one first vertical collecting surface of said at least one collecting electrode, and pouring liquid onto at least one second vertical collecting surface, said at least one second vertical collecting surface located at least on one of said at least one collecting electrode downstream of said at least one first vertical collecting surface and of at least one further collecting electrode, said at least one further collecting electrode located downstream of said at least one collecting electrode.

* * * * *